US007104417B2

(12) United States Patent
Hilliard

(10) Patent No.: US 7,104,417 B2
(45) Date of Patent: Sep. 12, 2006

(54) PILL DISPENSING APPARATUS AND SYSTEM

(75) Inventor: Brian Lee Hilliard, Vineland, NJ (US)

(73) Assignee: Comar, Inc., Buena, NJ (US)

( * ) Notice: Subject to any disclaimer, the term of this patent is extended or adjusted under 35 U.S.C. 154(b) by 203 days.

(21) Appl. No.: 10/440,635

(22) Filed: May 19, 2003

(65) Prior Publication Data

US 2004/0016763 A1 Jan. 29, 2004

Related U.S. Application Data

(60) Provisional application No. 60/381,649, filed on May 20, 2002.

(51) Int. Cl.
*G07F 11/66* (2006.01)

(52) U.S. Cl. ..... 221/25; 221/88

(58) Field of Classification Search ..... 221/25, 221/84, 121, 122, 87, 197, 82; 206/528, 206/531, 533, 534
See application file for complete search history.

(56) References Cited

U.S. PATENT DOCUMENTS 3,557,747 A * 1/1971 Rigney et al. ..... 116/308
3,743,085 A * 7/1973 Richert ..... 206/534
3,895,737 A * 7/1975 Phillips ..... 221/82
4,078,661 A * 3/1978 Thomas ..... 206/533
4,555,044 A * 11/1985 Pearo ..... 221/19
4,572,403 A * 2/1986 Benaroya ..... 221/3
4,971,221 A 11/1990 Urquhart et al.
5,249,709 A 10/1993 Duckworth et al.
D384,283 S 9/1997 Davies et al.
5,673,793 A 10/1997 Seidler
5,725,499 A 3/1998 Silverstein et al.
6,062,420 A * 5/2000 Krouwel et al. ..... 221/5
6,138,866 A 10/2000 Lambelet, Jr. et al.
6,325,241 B1 * 12/2001 Garde et al. ..... 221/87
6,364,155 B1 * 4/2002 Wolfe ..... 221/25
6,581,799 B1 * 6/2003 Garrant et al. ..... 221/88
6,651,840 B1 * 11/2003 Van Dullemen et al. ..... 221/88
6,669,022 B1 * 12/2003 Donegan ..... 206/531
2002/0030062 A1 * 3/2002 Garrant et al. ..... 221/87

* cited by examiner

*Primary Examiner*—Eileen D. Lillis
*Assistant Examiner*—Kaitlin Joerger
(74) *Attorney, Agent, or Firm*—Eugene E. Renz, Jr. P.C.

(57) ABSTRACT

Apparatus for dispensing pills packaged in a pack comprising a base and a top rotatably mounted on the base and defining a housing for the pill pack, a plunger mounted in the housing operable between inner and outer limit positions and having means for discharging one of the pills in the pack during cycling of the plunger between limit positions, means for rotating the pack only one pill increment at a time and child resistant means normally preventing cycling of the plunger between limit positions.

4 Claims, 17 Drawing Sheets

Fig-17
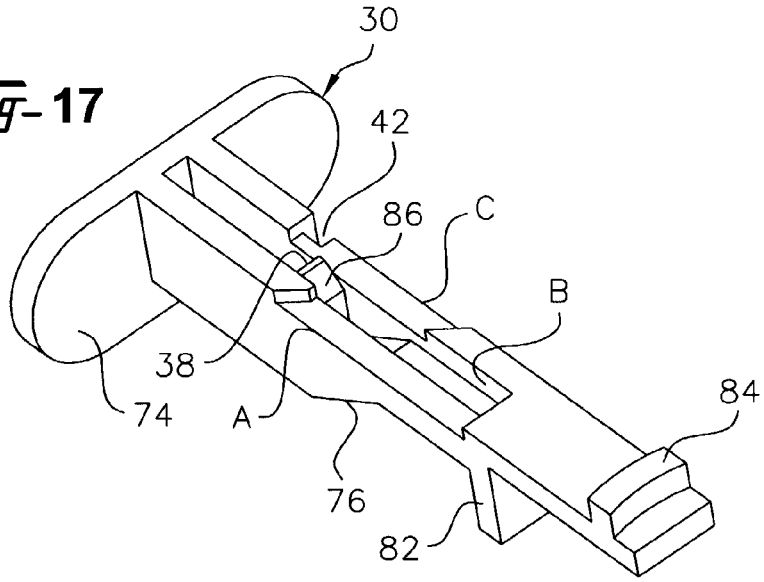
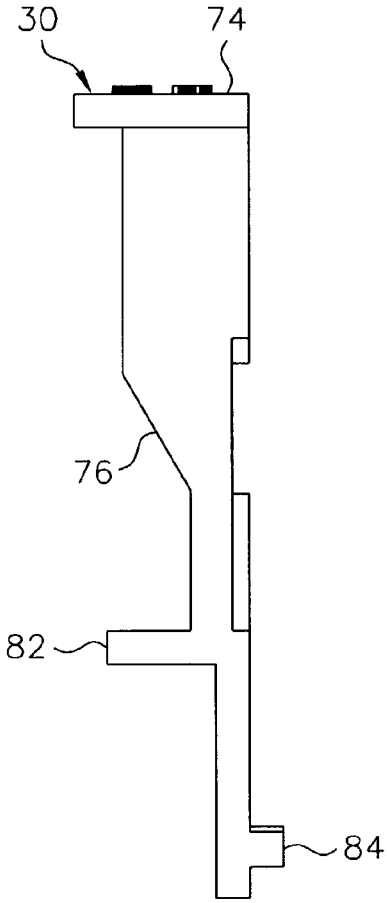
Fig-18
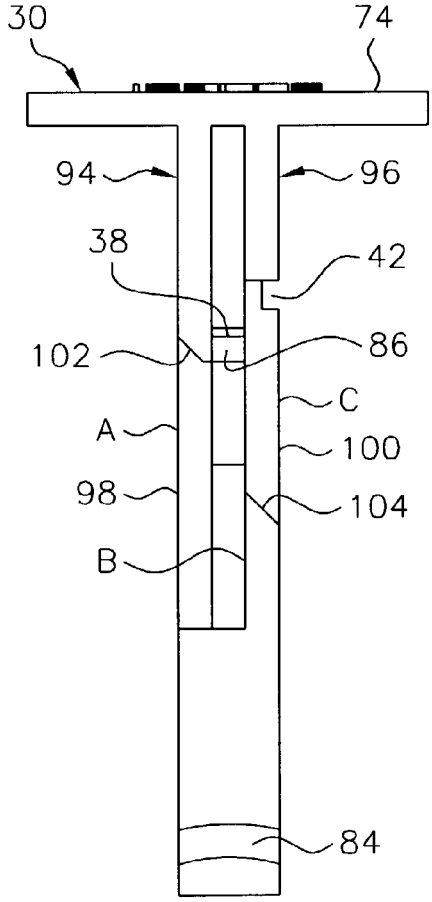
Fig-19

PILL DISPENSING APPARATUS AND SYSTEM

CROSS REFERENCE TO RELATED PROVISIONAL APPLICATION

This Application claims the benefit of Provisional Application Ser. No.: 60/381,649, filed May 20, 2002, entitled, PILL DISPENSING APPARATUS AND SYSTEM.

BACKGROUND OF THE INVENTION

The present invention relates to pill dispensing devices of the type incorporating a blister pack in which a product such as capsules, pills and the like are packaged in individual, recessed compartments of a so-called blister pack and means is provided for dispensing the pills or tablets one at a time. These pill dispensers usually hold a supply of pills, such as a one-month supply, and are designed so that the user can discharge the pills form the individual compartments. The prior art listed below has shown devices generally of this type.

REFERENCE PATENTS

1. SEIDLER
   U.S. Pat. No. 5,673,793
   DATE: Oct. 7, 1997
   BLISTER PACK WITH BUILT-IN PRODUCT EJECTION SYSTEM
2. DAVIES, et al.
   U.S. Pat. No. DES. 384,283
   DATE: Sep. 30, 1997
   BLISTER PACK DISK
3. DUCKWORTH, et al.
   U.S. Pat. No. 5,249,709
   DATE: Oct. 5, 1993
   CARTRIDGE SYSTEM FOR DISPENSING PREDETERMINED RATIOS OF SEMI-LIQUID MATERIALS
4. SILVERSTEIN, et al.
   U.S. Pat. No. 5,725,499
   DATE: Mar. 10, 1998
   DUAL BARRELED SYRINGE AND METHODS OF ASSEMBLY AND USE

Even though these prior art systems are generally effective for the purposes intended, there are some drawbacks and disadvantages which the system of the present invention addresses. For example, similar systems which are designed as child resistant are not truly child resistant. The system and apparatus of the present invention has an independent child-resistant locking feature which must be first activated before any of the mechanisms such as the shuttle can be manipulated to discharge a pill from the blister pack.

Another problem with the existing systems is that elderly, handicapped and lame person often find it difficult if not impossible to manipulate the pill activating system in these prior art devices. The present invention provides simple, direct and easy way to manipulate the elements to discharge one pill at a time by mature users.

SUMMARY OF THE INVENTION

The pill dispensing apparatus and system of the present invention comprises generally circular base having an upstanding side wall and a slightly semi-spherical top rotatable relative to the base and a disk-like blister pack containing a plurality of compartments in a circular array for housing pills or tablets. The system includes a shuttle operative between an inner and outer limit positions to discharge one pill at a time from the blister pack. The system further includes a child-resistant tab which normally locks the top against rotational movement relative to the base and therefore must be activated before the blister pill pack can be rotated for dispensing a pill or tablet.

In the operation of the system therefore, the user must press the child-resistant tab inwardly which releases the top so that it can be rotated in the present instance in a clockwise direction to present one pill at a time to the shuttle and when the shuttle is pressed inwardly it discharges the positioned pill through a window in the base and locks in an inner-limit position. The top can then be rotated in a clockwise direction only through one pill position to present the next pill in line for discharge and release the shuttle to its outer-limit position.

With the foregoing in mind, it is an object of the present invention to provide a new and improved pill dispensing apparatus and system which is characterized by novel features of construction and arrangement so that it is truly child resistant and functions in a manner to control discharge of one pill at a time, each cycle requiring that the child resistant system be reactivated.

It is a further object to the present invention to provide a pill dispensing apparatus and system which is easy and economical to manufacture and is easy to manipulate by adult users even the elderly, handicapped and lame.

BRIEF DESCRIPTION OF THE DRAWINGS

These and other objects of the present invention and the various features and details of the operation and construction thereof, are hereinafter more fully set forth with reference to the accompanying drawings wherein;

FIG. 17 is a perspective view of the plunger;

FIG. 18 is a side elevational view of the plunger;

FIG. 19 is a top plan view of the plunger;

DETAILED DESCRIPTION OF THE PREFERRED EMBODIMENTS

Figure 1:
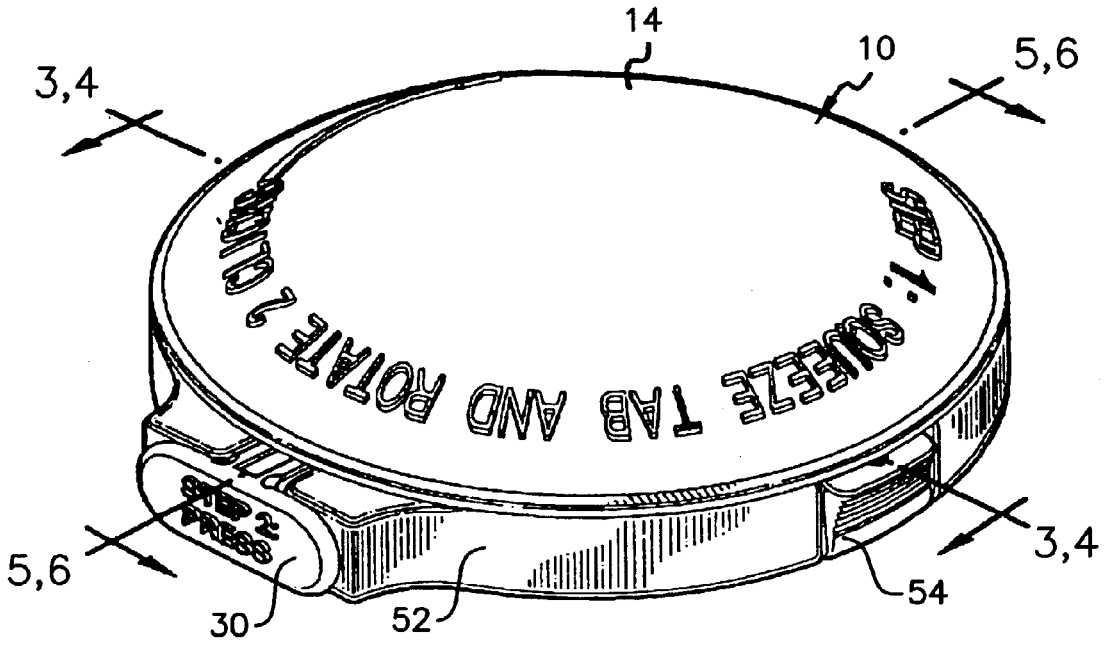
FIG. 1 is a perspective view of a pill dispensing apparatus and system in accordance with the present invention.
Figure 2:
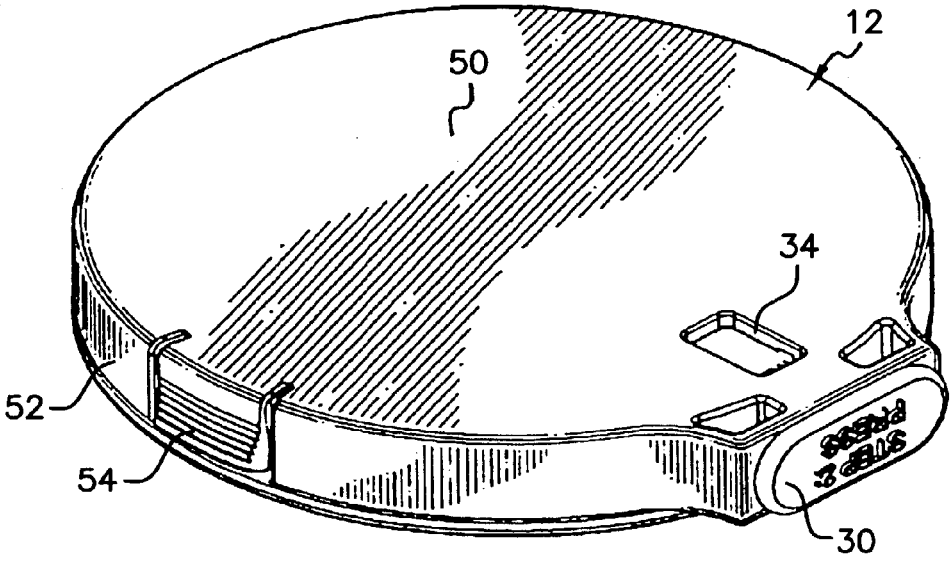
FIG. 2 is a perspective view of the pill dispensing system shown in FIG. 1 as view from the bottom.
Figure 3:
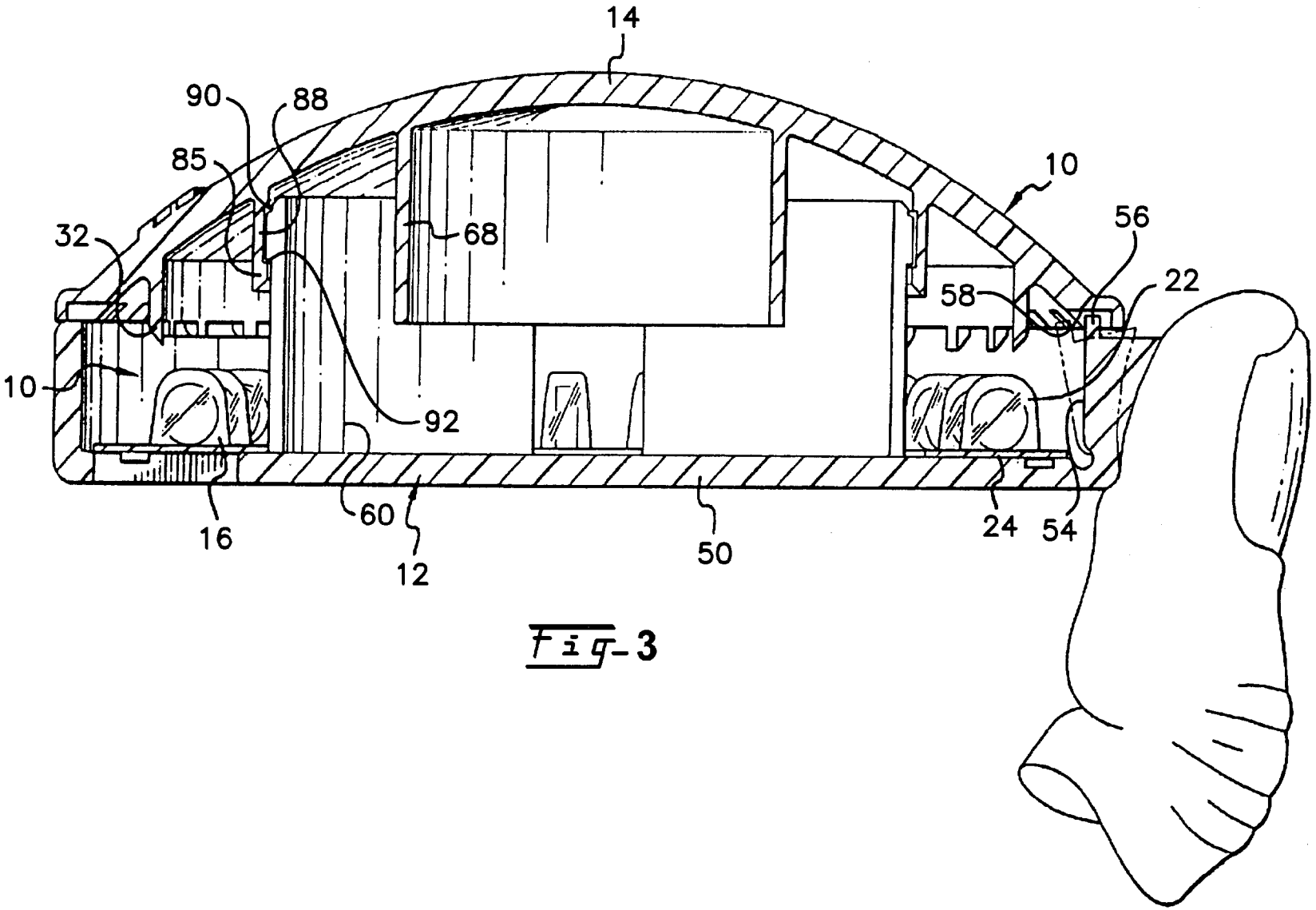
FIG. 3 is an enlarged sectional view taken through lines 3—3 of FIG. 1.
Figure 4:
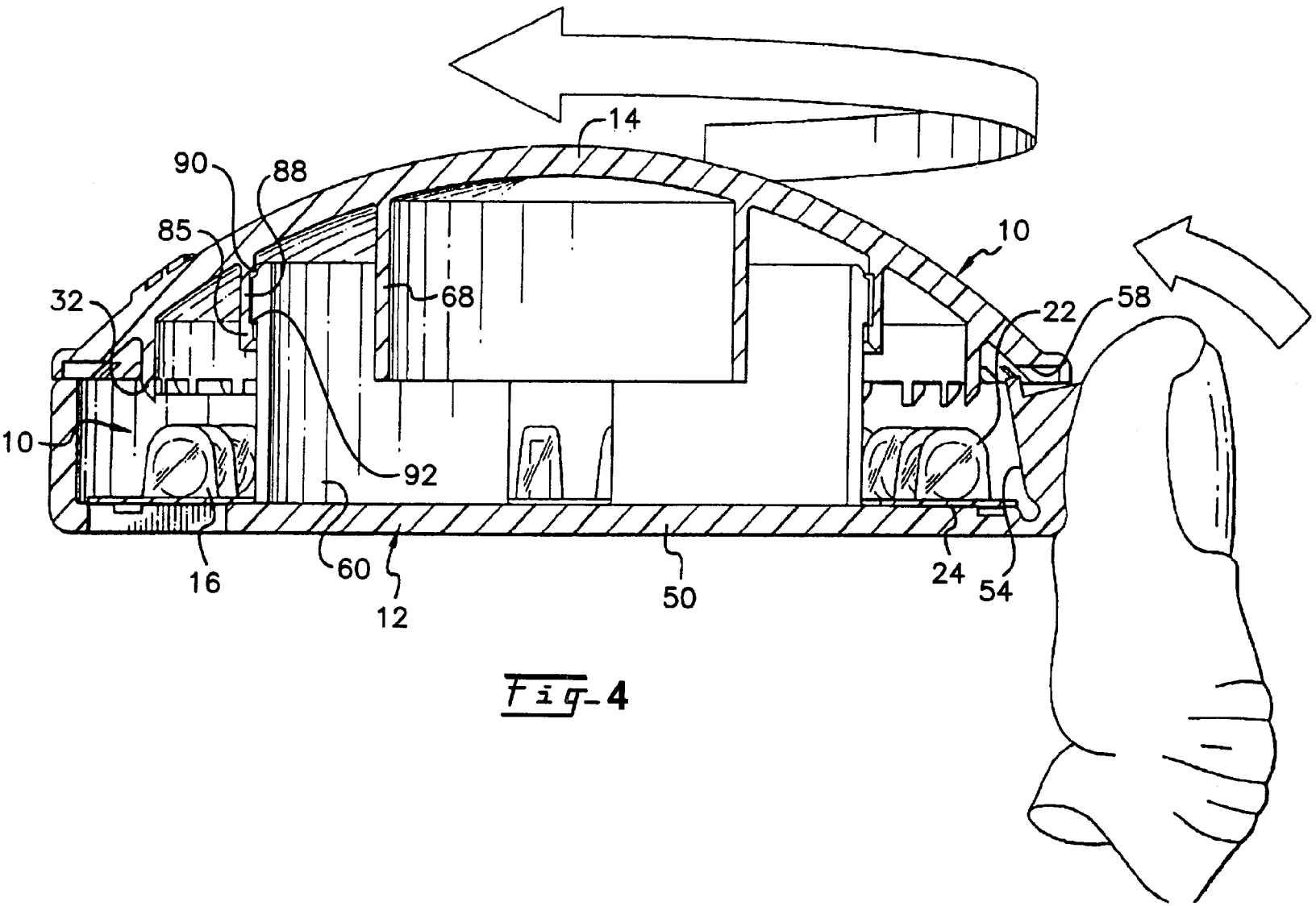
FIG. 4 is a sectional view similar to FIG. 3 taken on lines 4—4 of FIG. 1 with the tab pressed inwardly to release the top for rotation to advance the pill cartridge.

In accordance with the present invention, the pill dispensing system (10) is characterized by novel features of construction and arrangement, including a novel shuttle or plunger (30) actuatable radially between inner and outer limit positions in a trackway (T) formed in the base (12) and a series of flexible fingers (32) projecting downwardly from the cover (14) which inter, engage and cooperate in a manner explained in more detail herein below to align a pill at the discharge window (34) in the base (12). The system includes a child resistant means in the form of a pivotally actuated tab (54) which normally locks the system and prevents activation and any discharge of pills until activated by an adult user.

Figure 13A:
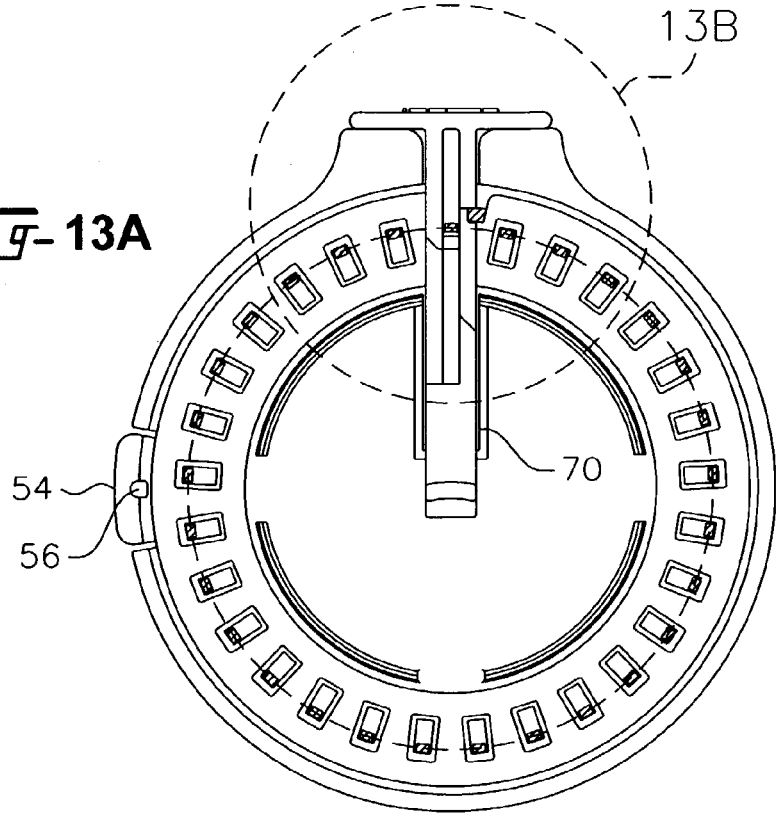
FIG. 13A is a top plan view with the top of the pill dispensing apparatus and system removed to show the position of the plunger and the pill pack in the start position.
Figure 13B:
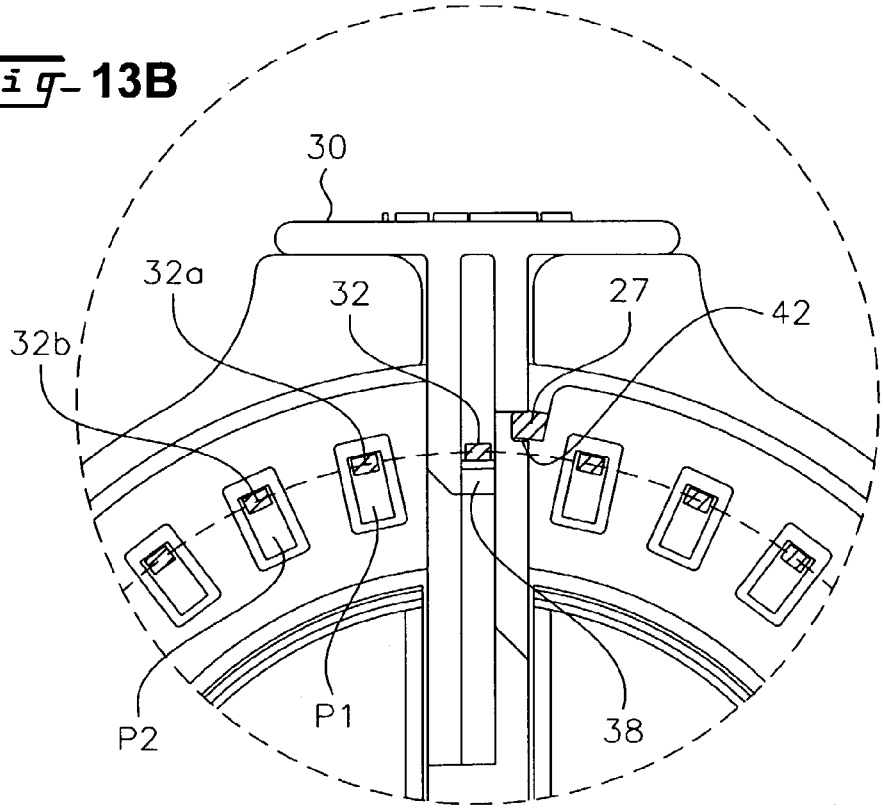
FIG. 13B is a fragmentary top plan view of the portion encircled in FIG. 13A and identified by the numeral 13B.

Consider now briefly a cycle of operation. In the initial starting position shown in FIG. 13, the shuttle (30) is in its inward limit position, wherein one of the cover fingers (32) is aligned with the plunger finger (38) to retain the plunger in the inner limit position against the normal outward bias of the spring (40). Note that in this position, blister pack advancement post (27) is positioned in a notch (42) in the side of the plunger (30) for assembly alignment purposes only. In this position, child resistant tab (54) is pushed inwardly as shown in FIG. 14 and the cover (14) is rotated clockwise. When cover finger (32) rotates past plunger finger (38), plunger (30) slides outwardly as urged by spring (40) to its outer limit position and one audible click is produced as cover finger passes over plunger wall (C) (see FIG. 14).

Figure 15A:
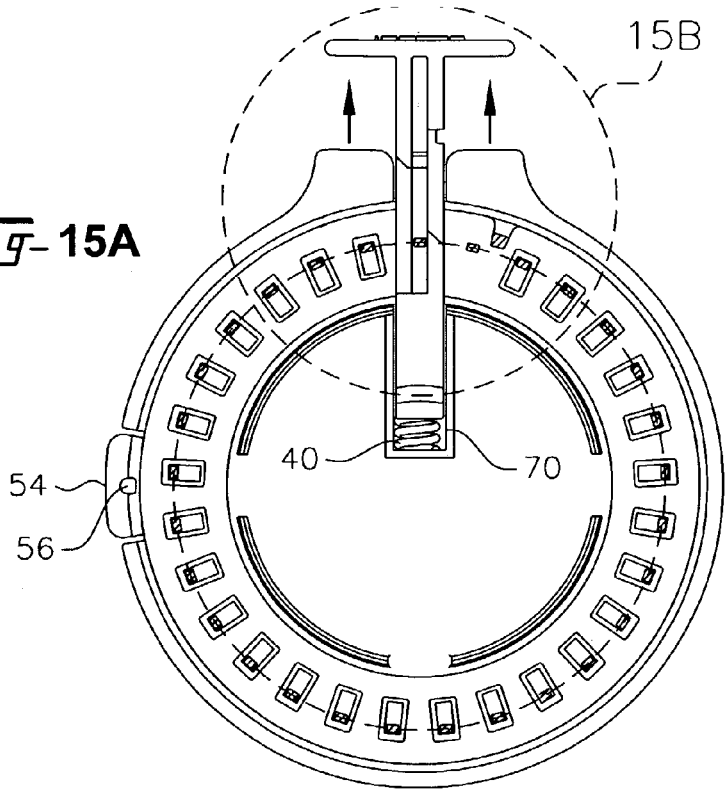
FIG. 15A is a top plan view similar to FIG. 14A showing the plunger in its full outer-limit position.
Figure 15B:
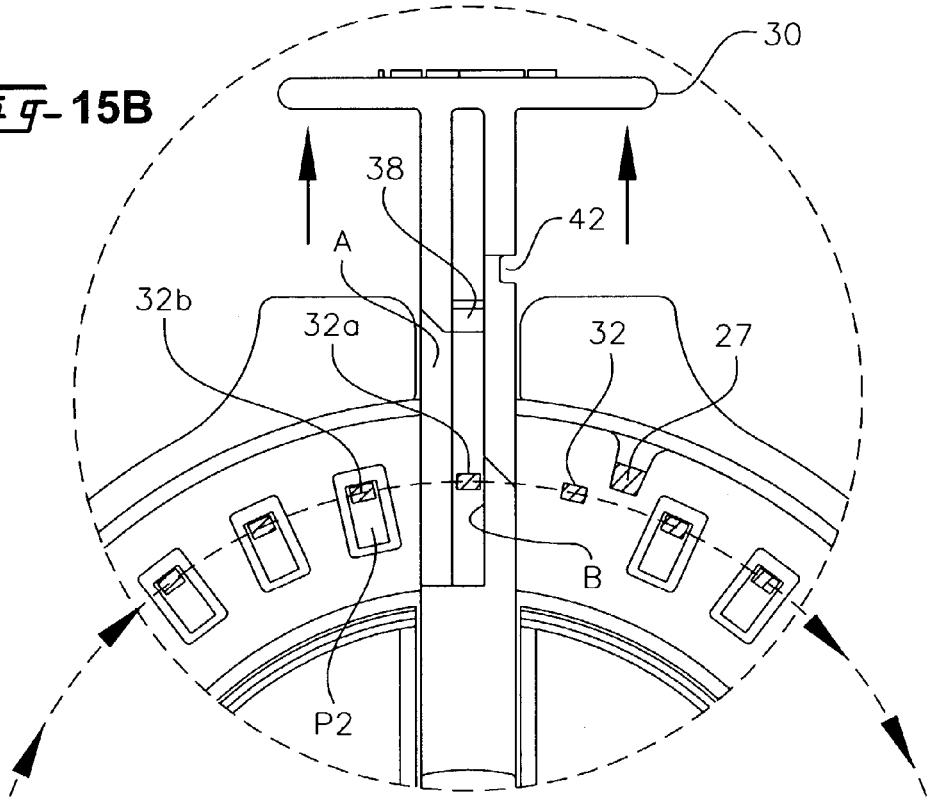
FIG. 15B is an enlarged portion showing the elements encircled in FIG. 15A and identified by the numeral 15B.

Cover (14) will rotate until the next cover finger (32*a*) passes over the lower wall (A) and abuts wall (B) which is now in its rotational path (see FIG. 15). Cover finger (32*a*) aligns itself between plunger wall (A) and plunger wall (B), and child resistant tab (54) will snap into another pocket (58) molded in the cover to lock rotation of the cover (14A) accordingly cycling the plunger (30) between limit positions only advances the blister pill pack (16) one pill location, and accordingly, only one pill at a time can be dispensed.

Considering now component parts of the apparatus and system in more detail the apparatus and system comprise a cup-shaped base (12) and a spherical cover (14) which houses an annular blister pack (16) for a plurality of pills to be dispensed. The blister pack (16) as illustrated comprises a multiple compartment thermo-formed plastic casing (18) shaped to define a series of circumferentially spaced upstanding compartments (22) for the individual pills (P) and a pierceable closure cover (24) suitably secured to the casing 18 to seal the product in the respective compartments (22). The cover or base (24) has a notched cutout (25) in its outer circumferential edge for an advance post (27) carried by the cover (14) so that the blister pack (16) rotates with the cover (14) as explained in more detail later.

The blister pack (16) is formed in a generally conventional manner first by thermo-forming the plastic casing (18) with a plurality of circumferentially spaced compartments (22) and then filling each compartment with the desired pill or capsule (P) product and thereafter applying a sealing film (24) such as a foil material to the lower surface of the thermo-formed casing (18) to seal each of the openings in the compartments 22 and thereby secure the product therein.

The base (12) is generally of cup-like form having a disc-like bottom wall (50) and an upstanding peripheral side wall (52). A child resistant tab (54) is formed in the side wall (52) approximately ninety degrees (90°) removed from the shuttle or plunger trackway (see 9B) and is pivotally hinged at the juncture of the side wall (52) and bottom wall (50). The child resistant tab (54) has an axially upwardly directed pin (56) which in its normal relaxed position engages one of a series of circumferentially spaced pockets (58) in the interior outer periphery of the cover (14). The pin (54) when pressed inwardly engages radially inwardly of the array of pockets (58) in the cover (14) to allow rotation of the cover (14) relative to the base (12) in a manner described generally above and which will be discussed more specifically later.

Figure 7:
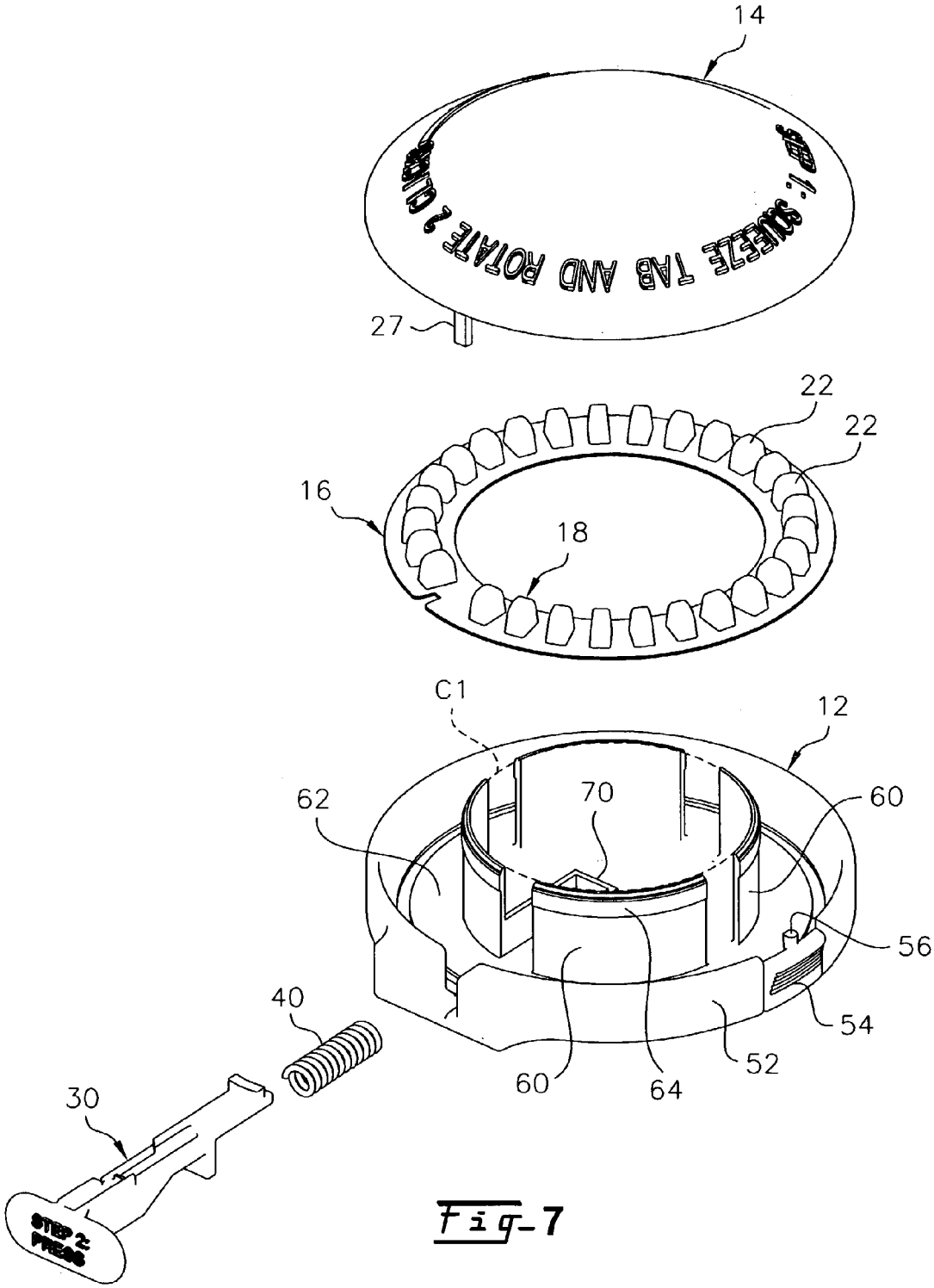
FIG. 7 is an exploded perspective view of the components including the base and top for the pill dispensing apparatus and system of the present invention.
Figure 9A:
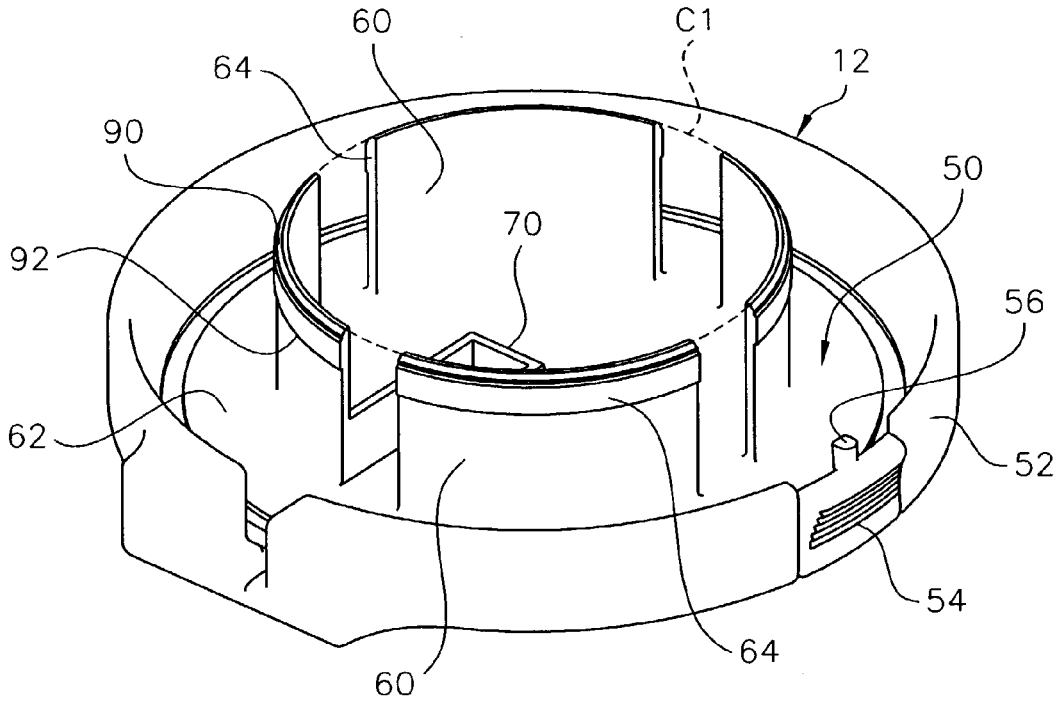
FIGS. 9A and 9B are perspective views of the base.
Figure 9B:
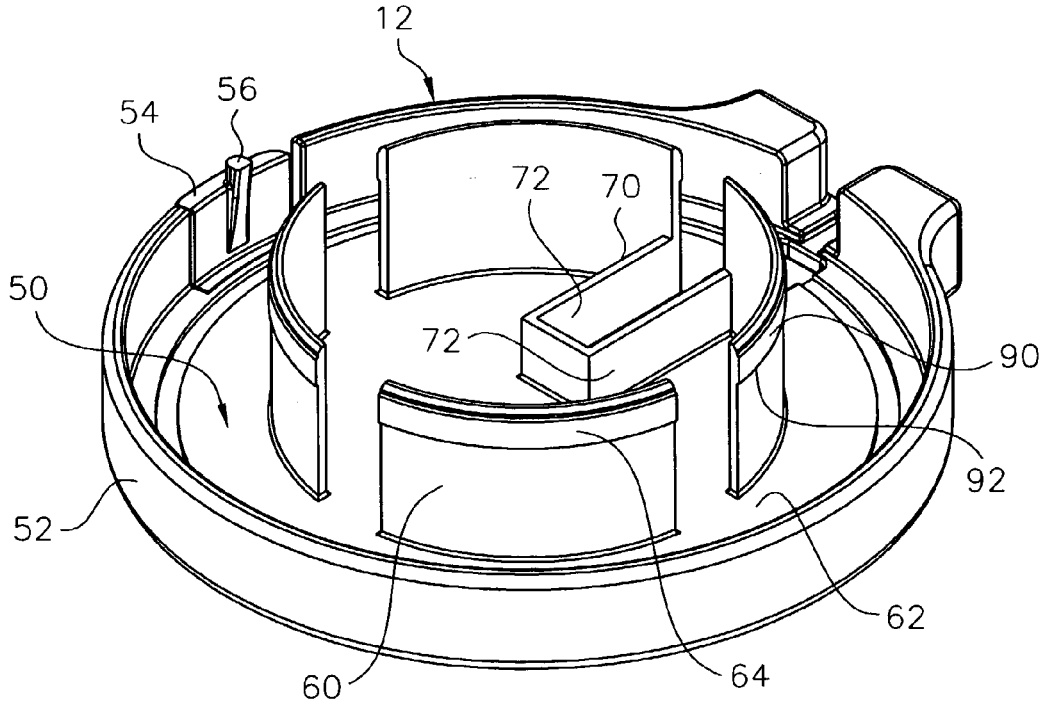
Figure 10:
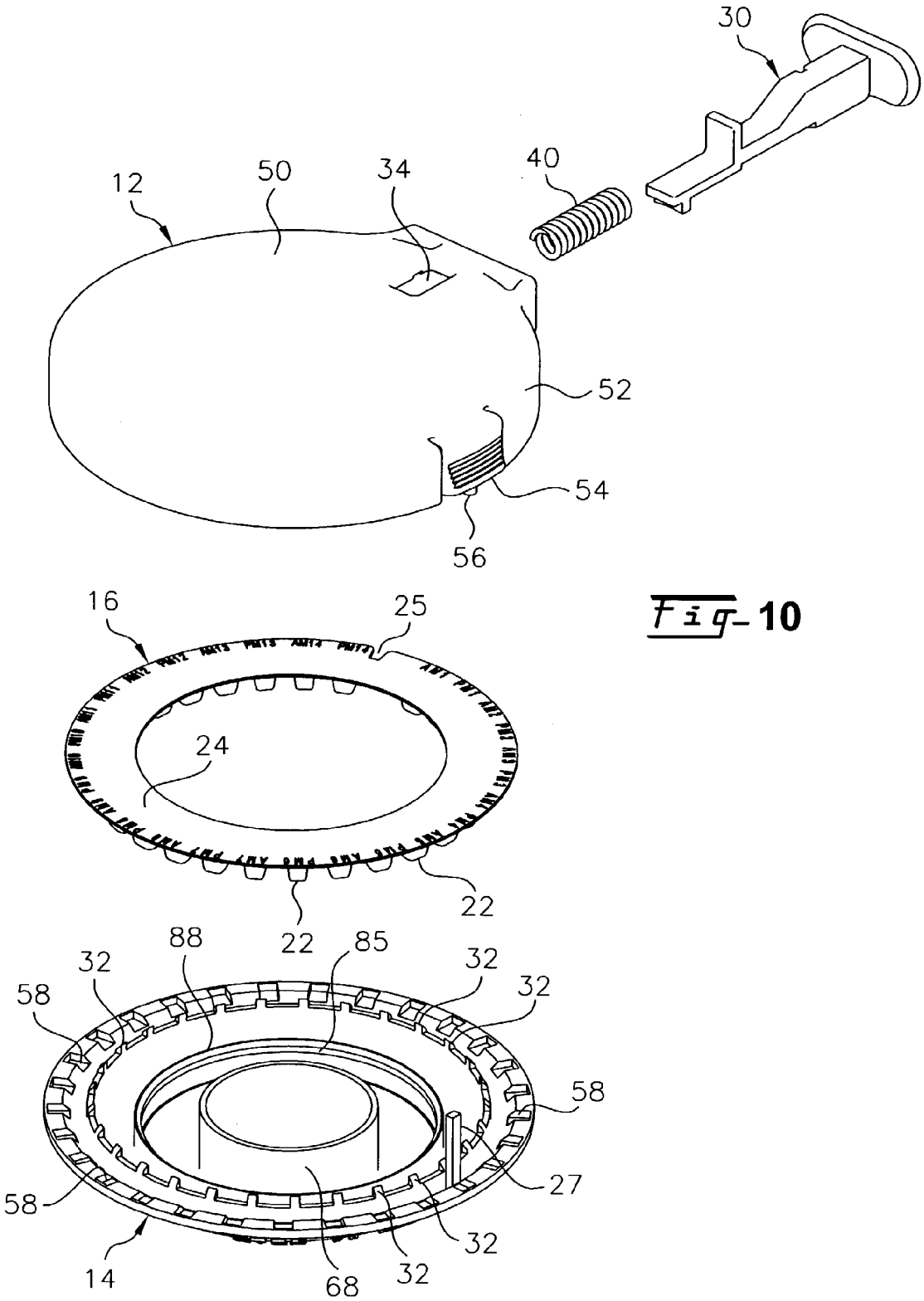
FIG. 10 is an exploded perspective view of the components of the dispensing apparatus and system viewed from the bottom.
Figure 11:
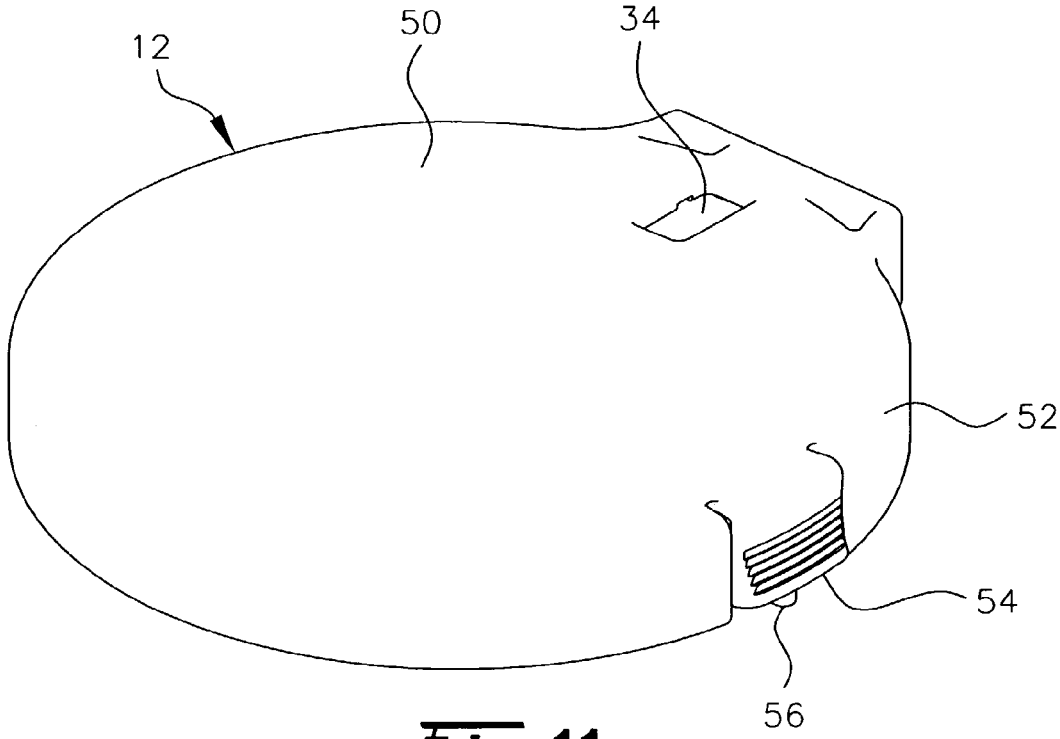
FIG. 11 is a perspective view of the base showing the discharge window.
Figure 12:
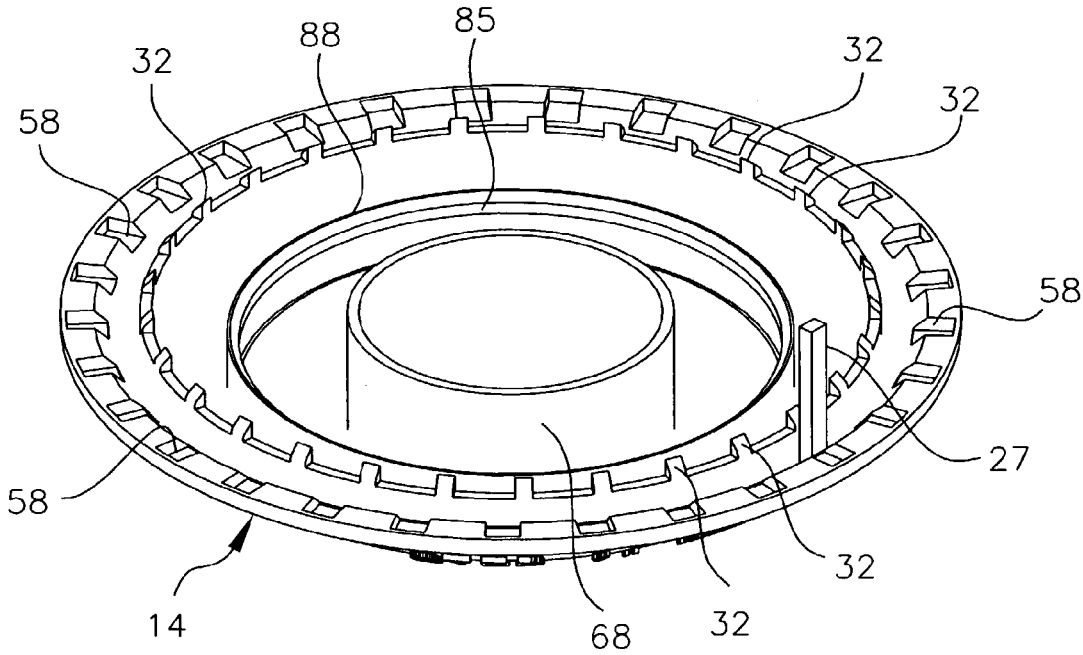
FIG. 12 perspective view showing the inside of the top.

The base assembly (12) as best illustrated in FIGS. 9A and 9B has a series of four (4) upstanding arcuate walls (60) which lie on the circumference of a circle (C1) spaced radially inwardly from the outer peripheral wall (52) of the base (12) and are generally concentric to the base side wall (52) to define an annular circumferentially extending channel (62) for the blister pack (16) as shown in FIG. 7. The walls (60) are formed with locking ribs (64) and have a degree of flexibility so they can deflect inwardly and lock with a complementary locking ribs on the interior wall of a cylindrical projection (68) depending from this cover (14) in the manner shown in FIG. 14.

Figure 8A:
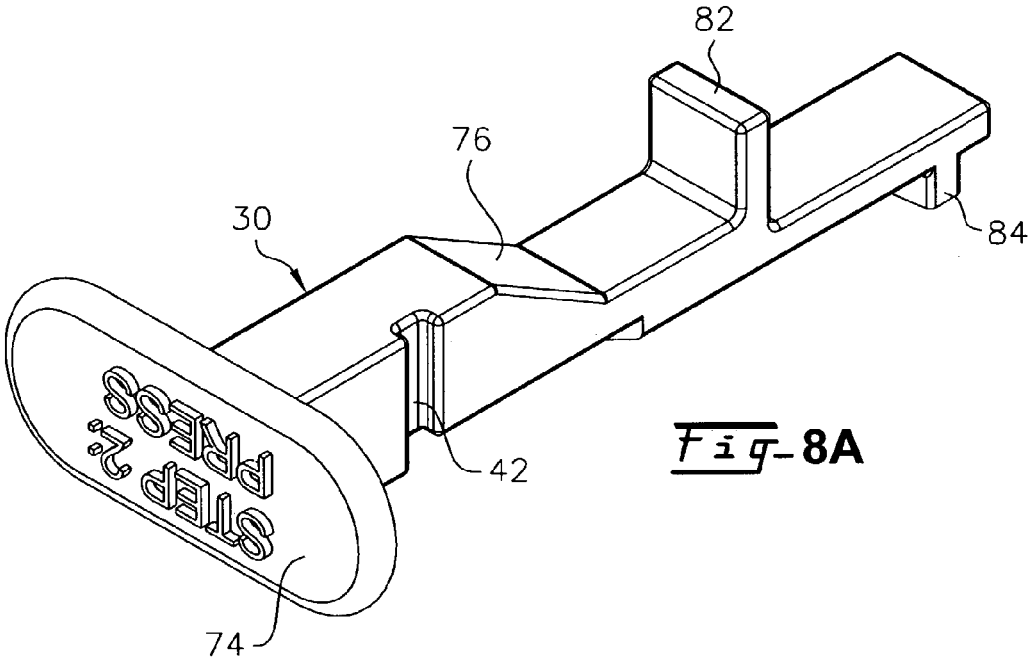
FIGS. 8A and 8B are perspective views of the plunger.
Figure 8B:
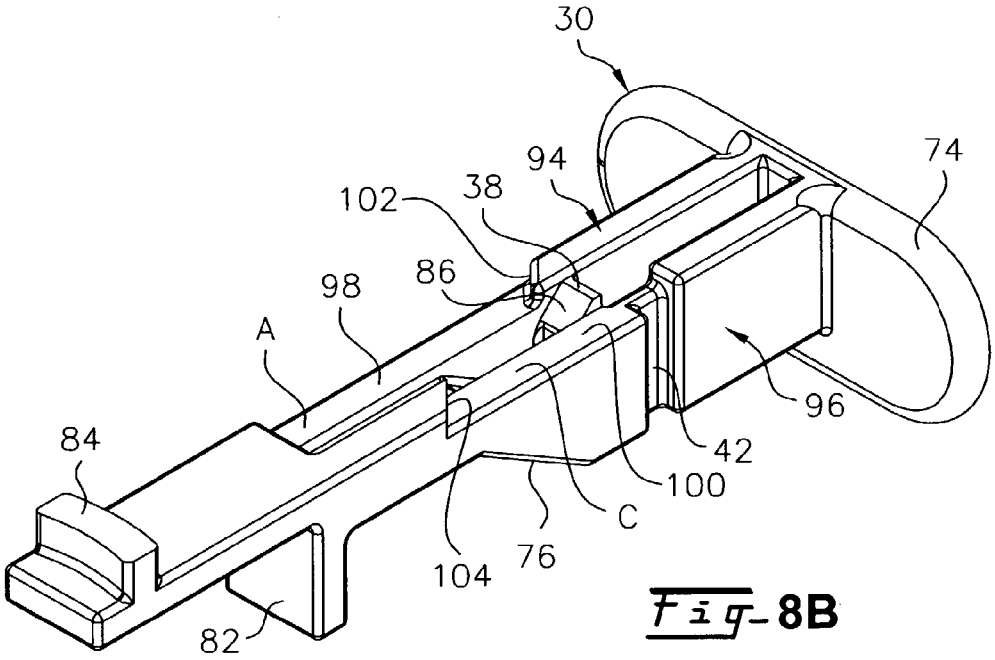
Figure 14A:
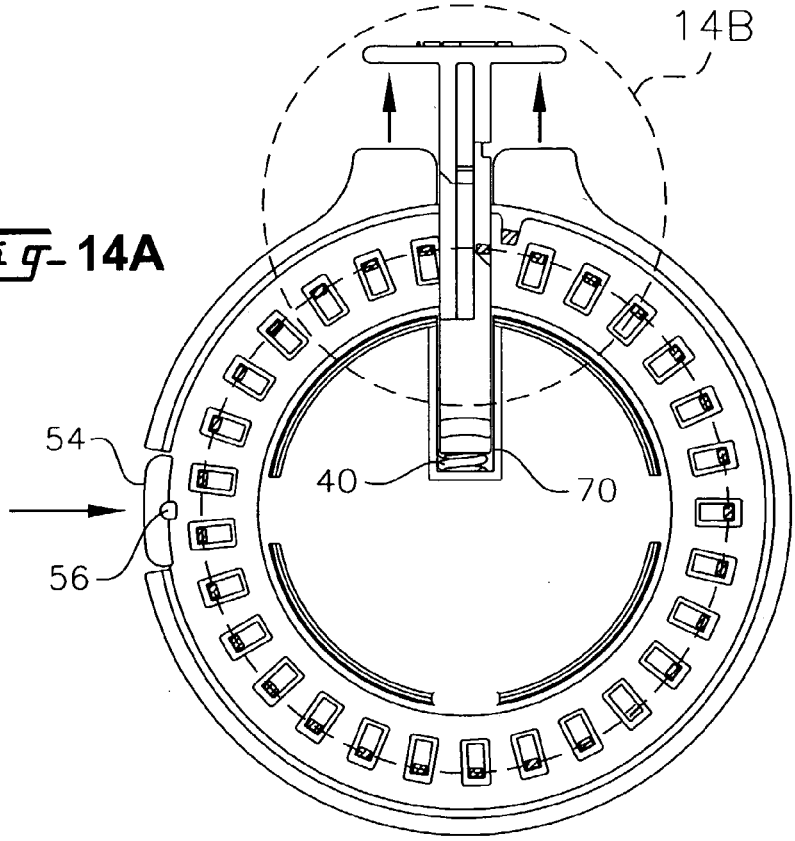
FIG. 14A is a top plan view showing the position of the parts after activation of the child resistant tab which permits rotation of the top relative to the base to position a pill in a discharge position by the plunger.
Figure 14B:
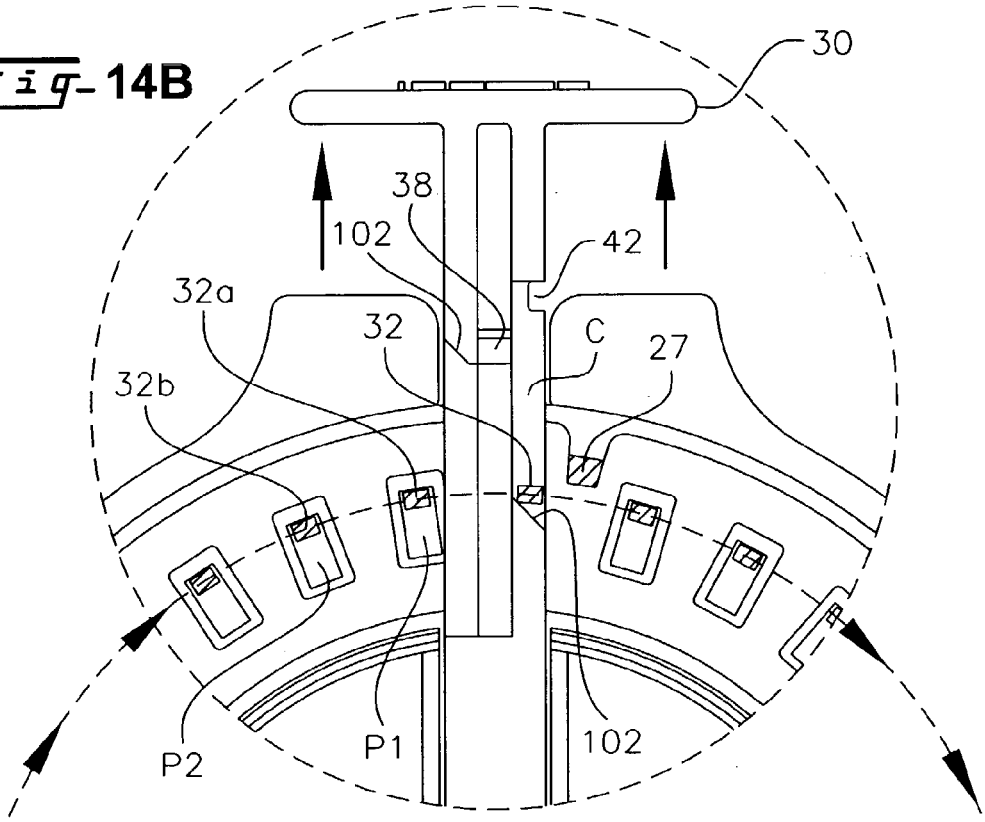
FIG. 14B is an enlarged view of the parts showing details of the plunger partially withdrawn as shown in the encircled portion of FIG. 14A and designated by the numeral 14B.

As shown in FIG. 9B, the plunger shuttle (30) is mounted in a trackway formed by a pair of radially directed spaced walls (72), (72) which extend inwardly towards the center of the base from two of the adjacent base wall segments (60). The plunger (30) as illustrated in FIG. 8A has a finger push portion (74) at its outer terminal end and an upwardly inclined offset ramp (76) which is illustrated in FIGS. 8A and 8B engages the pill pack (16) when the plunger (30) is activated radially inwardly to discharge a pill from one of the compartments through the pill discharge window (34). The plunger as best shown in FIGS. 8A and 8B, includes a pair of spaced side walls (94 and 96) which straddle the plunger finger (38). The top edge of each side wall (94 and 96) is cut away as at (98 and 100) to define the walls (A and C). The cutouts (98 and 100) are staggered longitudinally to provide a means for limiting rotation of the top to dispense one pill at a time when the plunger (30) is cycled between inner and outer limit positions. The side wall portions defining the staggered cutouts (94 and 96) in the side walls are beveled as at (102 and 104) to deflect a top finger (32)

when the plunger (30) is cycled between limit positions and insure smooth operation of the plunger (see FIGS. 14A and 14B).

Figure 5:
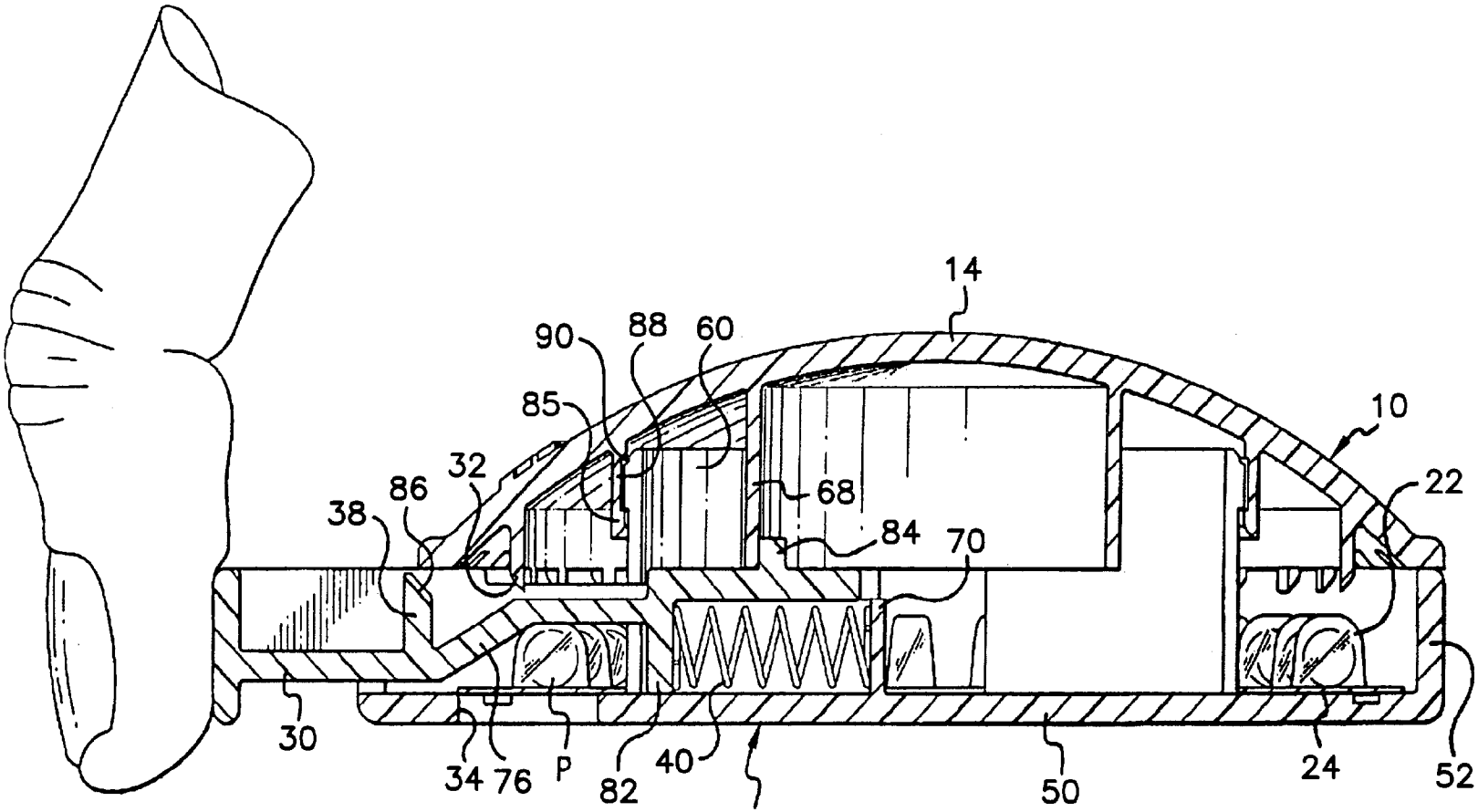
FIG. 5 is an enlarged sectional view taken on lines 5—5 of FIG. 1 showing the pill actuating member in an outwardly biased position.
Figure 6:
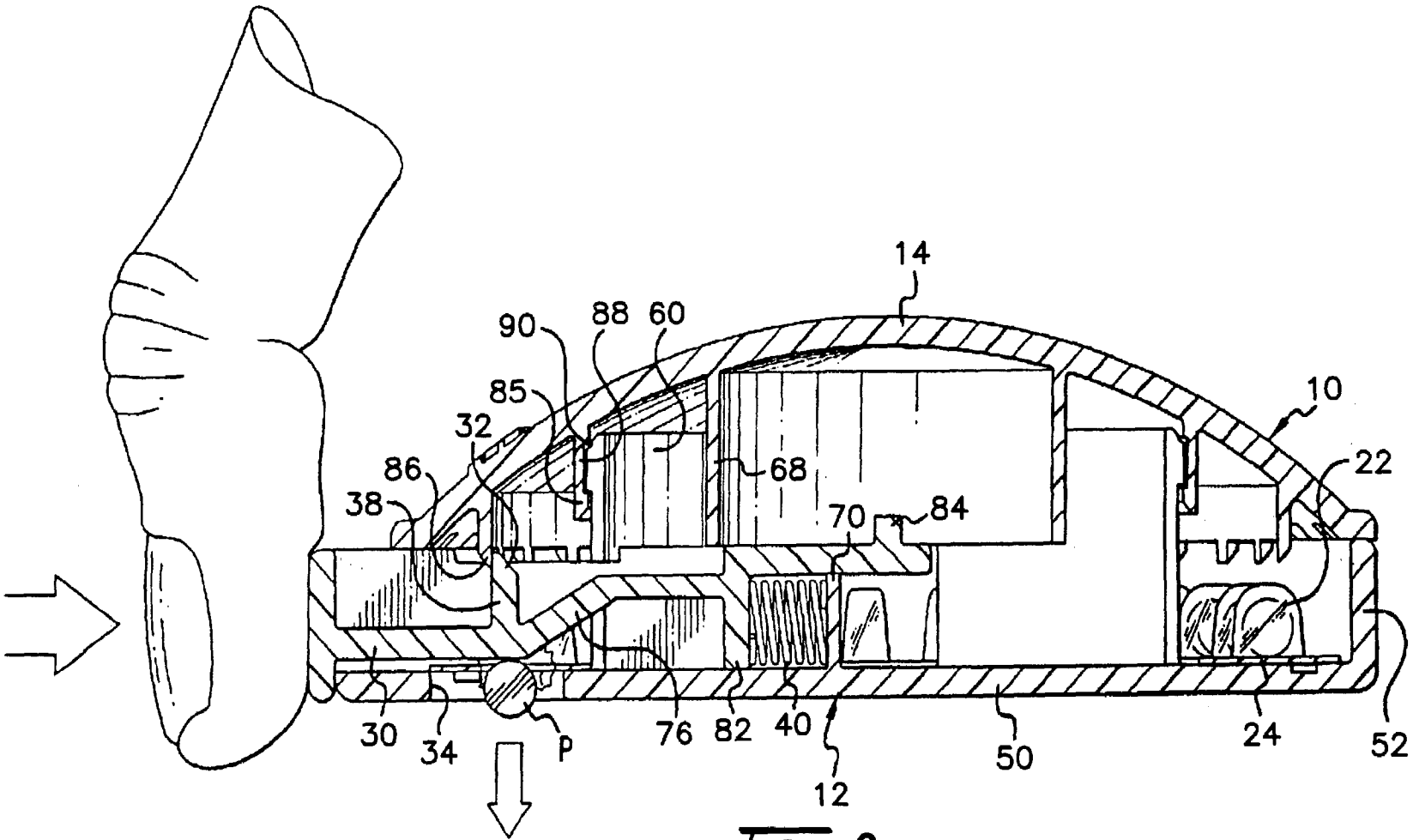
FIG. 6 is a sectional view similar to FIG. 5 with the pill actuating element pressed inwardly to dispense a pill from the cartridge.

As illustrated, the plunger (30) is normally biased to an outer limit position (see FIG. 14) by a spring (40) which engages between the end stop (80) defined by the trackway (70) and the vertical stop projection (82) on the plunger (30). The forward end of the plunger has an upwardly directed lug (84) which limits outward travel of the plunger (30) and in its normal position abuts or engages cylindrical wall (68) which depends from the top (14) (see FIG. 5). The plunger (30) has an upstanding flexible finger (38) which is tapered as at (86) and extends upwardly to a point or region where it engages and deflects one of the fingers (32) when the plunger is activated from its outer limit position to its inner limit position (see FIG. 6) Note that after a pill has been dispensed, the plunger (30) is locked in its inner limit position by inter engagement of the plunger finger (38) and one of the top cover flexible fingers (32).

Considering now more specifically the details of the cover (14), the cover includes the cylindrical wall (68) and a larger cylindrical wall (88) concentric to the wall (68) which provides an abutment and defines a limit position for the plunger (30) in the manner described above. The wall (88) has a beveled peripheral edge as at (90) and an interior ridge (92). By this arrangement, the cover (14) can be assembled over the base (12) by simply positioning the cover (14) in place so that the beveled edge (90) seats on the upper beveled edge ($60^{\alpha}$) of the base wall segments (60) which as noted above are flexible so that when the cover (14) is pressed downwardly, the wall segments (60) yield sufficiently to permit inter engagement of the ridges (64 and 92) to lock the parts in place.

Consider now assembly of the parts comprising the pill dispenser of the present invention. The blister pill pack (16) is first positioned in the annular groove or channel (70) in the base (12) with none of the other parts assembled. The plunger or shuttle (30) and plunger spring (40) are then assembled. With the plunger (30) in its outer limit position (see FIG. 5), the cover (14) is positioned over the base (12) and rotated so that the parts are in the position shown in FIG. 13A with the advancement post (27) engaging in the blister pack cutout (25). In this position, the cover (14) is simply pressed downwardly whereby the inter engaging locking ribs or ridges (64) on the segmented inner wall segments (68) of the base (12) and the rib or ridge (92) of the top cover wall (88) engage to lock the parts in place. The parts are then in the position shown in FIG. 13A wherein the pin (56) of the child resistant tab (54) engages in one of the locking slots or pockets (58) in cover (14). Note that the plunger (30) is locked in the inner limit position at the start by engagement of the plunger finger (38) and one of the top fingers (32) with which it is aligned.

Figure 16A:
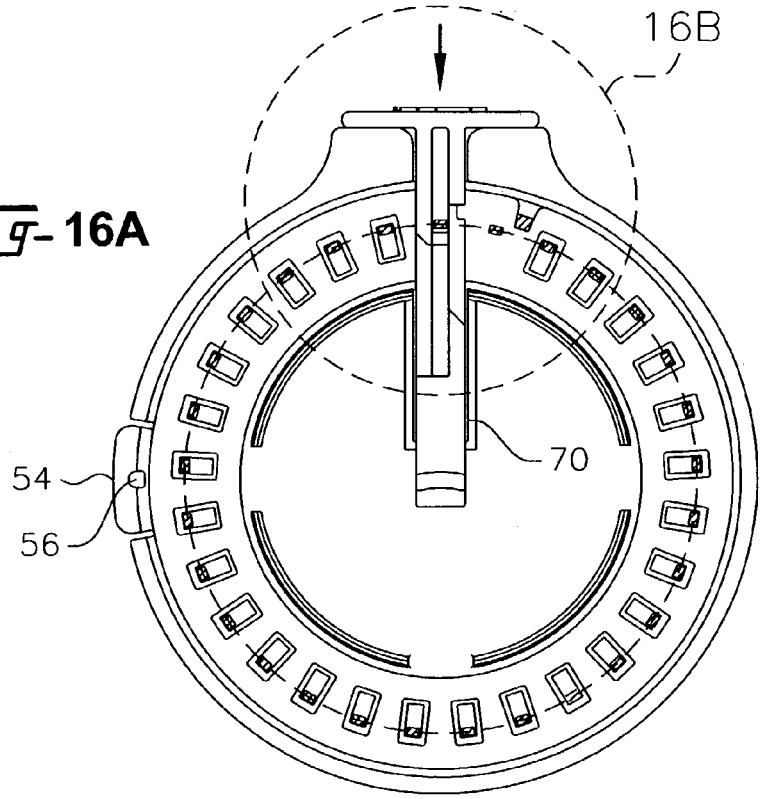
FIG. 16A is a view showing activation of the plunger to discharge the next pill from the pill pack.
Figure 16B:
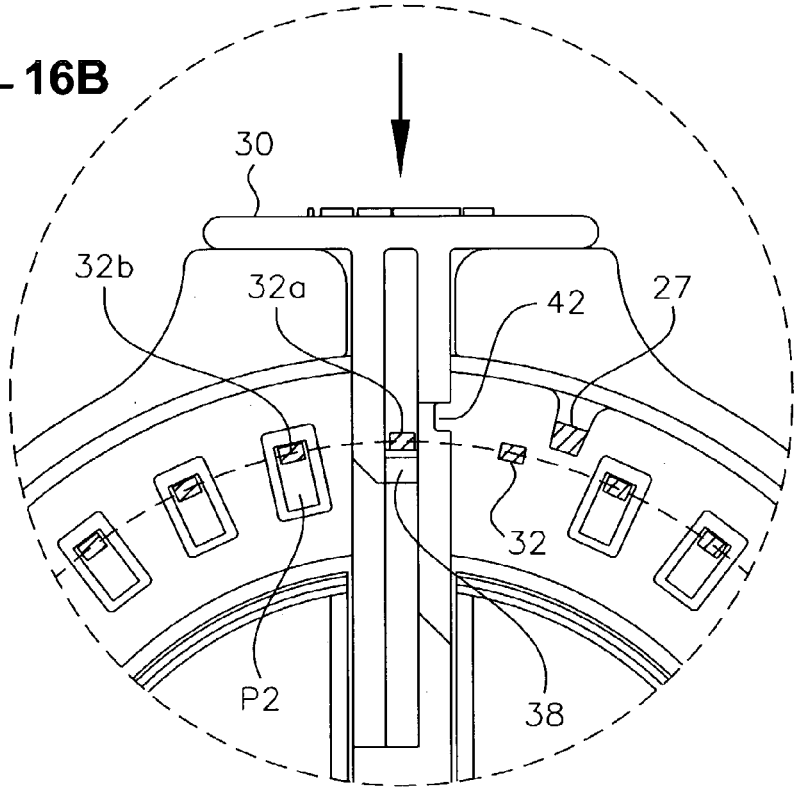
FIG. 16B is an enlarged view of the parts encircled in FIG. 16A and designated by the numeral 16B.
Figure 20:
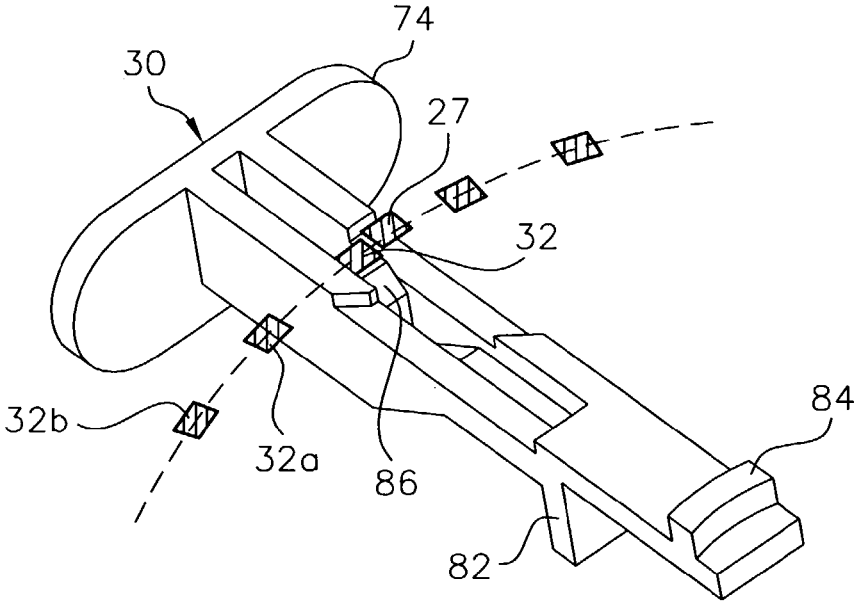
FIGS. 20–23 inclusive are perspective views showing various positions of the plunger relative to the flexible fingers which project from the top and are operative to produce the desired cycle of operation described in the specification.
Figure 21:
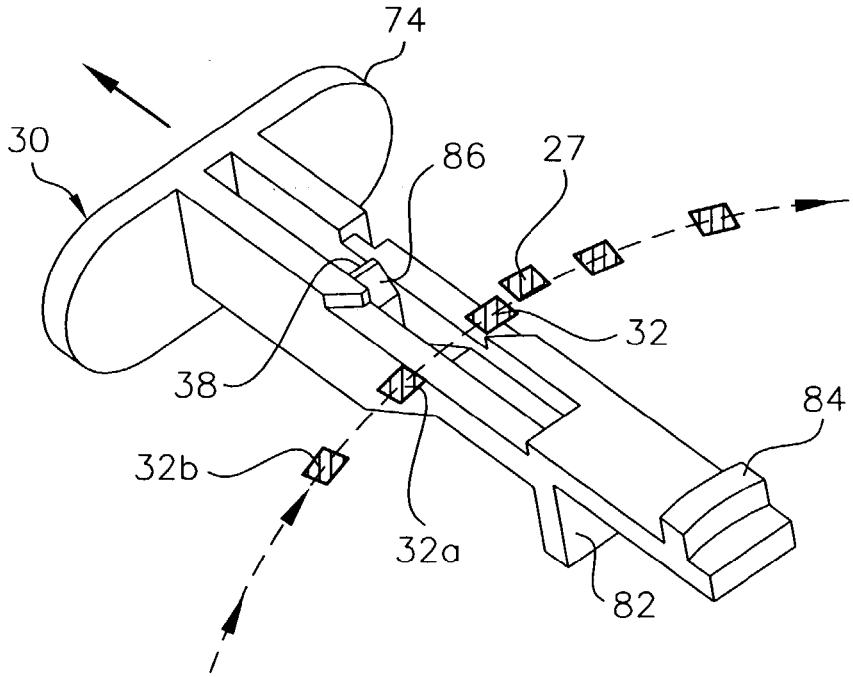
Figure 22:
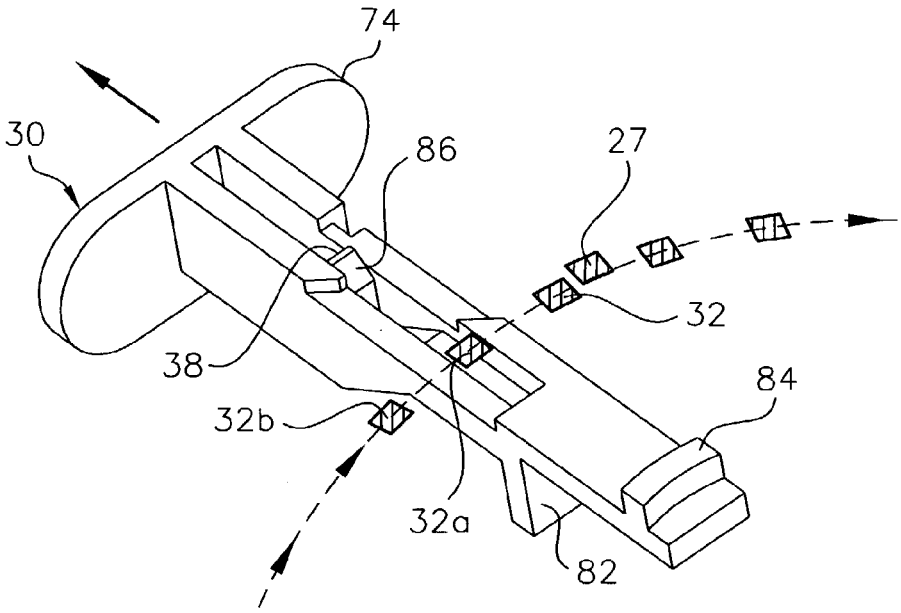
Figure 23:
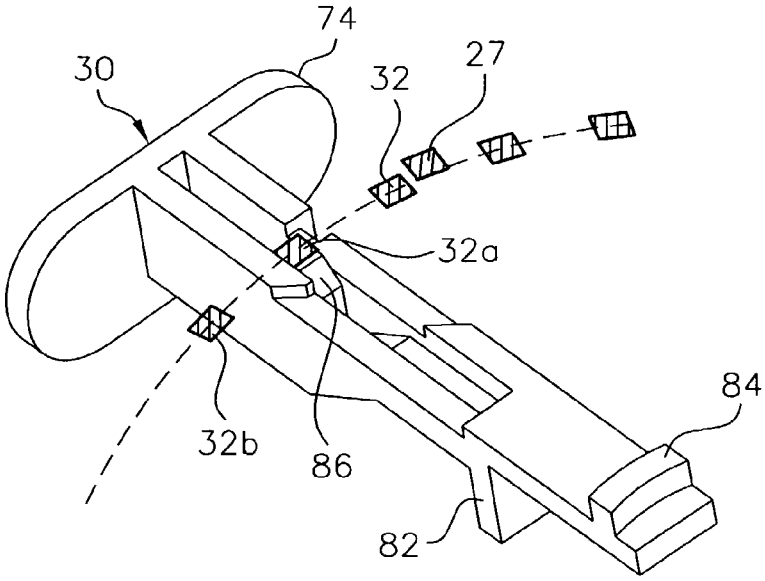

When it is desired to discharge a pill from the pill pack assembly (16), the user presses the child resistant tab (54) inwardly to move the pin (56) to a position outside the pocket (58) which permits the cover to be rotated in a clockwise direction as seen in FIG. 14A. When the cover (14) is moved to a position wherein the plunger finger (38) is no longer aligned with the top finger (32*a*), the plunger spring (40) pushes the plunger radially outwardly to a point where the sidewall of the plunger forwardly of the wall (C) is in the path of the top finger (32*b*) thus limiting rotation of the top to one increment (see FIGS. 14B and 16A). The plunger (30) is now aligned with one of the pills in the pill pack (16) whereby the plunger (30) can be pressed radially inwardly whereby the pill is dispensed by engagement of the inclined ramp (76) and pill drops through the discharge window (34) in the base (see FIGS. 6 and 7). The plunger finger (38) flexes past the top finger (32*b*) with which it is aligned and locks the plunger in place in the manner shown in FIGS. 16A and 16B. Note that when the child resistant tab (36) is released, the pin (56) engages in a locking slot or pocket (58) in the cover (14) so the cycle can now be repeated. It is noted that the staggered recesses defining the walls (A and C) in the plunger are positioned such that they alternately permit passage of a top finger (32) and block the same to provide the desired one pill at a time dispensing action. Note also that the beveled edges and defining the walls (A and C) ensure against blockage and hang up of the system when cycling the plunger in the manner described above.

Even though a particular embodiment of the present invention has been illustrated and described herein, it is not intended to limit the invention and changes and modifications may be made therein within the scope of the following claims.

What is claimed is:

1. Apparatus for dispensing pills packaged in a pack comprising a base and a top rotatably mounted on the base and defining a housing for the pill pack, a pill dispensing window in said base, a radially extending plunger slidably mounted in the housing operable between inner and outer limit positions, said plunger having a ramp adapted to engage the pill pack for discharging one of the pills in the pack through the window in said base during cycling of the plunger between limit positions, means for limiting rotation of the pack only one pill increment at a time, and a child resistant means normally preventing cycling of the plunger between limit positions, said child resistant means comprising a hinged tab on the base, a pin-like projection on said tab, a plurality of circumferentially spaced pockets in the top adapted to receive said pin-like projection to prevent rotation of the top relative to the base, whereby when the tab is pressed inwardly, the pin is moved out of a respective pocket to allow rotation of the cover and associated pill pack.

2. Apparatus as claimed in claim 1, wherein said base includes a series of segmental walls and said top includes a wall, said walls having interengaging locking means for assembly of the top and base.

3. Apparatus as claimed in claim 1, wherein a plurality of circumferentially spaced fingers depend from said top, said plunger being configured to receive a respective finger for controlling displacement of the plunger to the extent of advancing the pill pack one increment while cycling the plunger between limit positions to dispense one pill at a time.

4. Apparatus for dispensing pills packaged in a pack comprising a base having a bottom wall and a top rotatably mounted on the base, said base including a series of segmental walls and said top including a wall, said walls having interengaging locking means for assembly of the top and base defining a housing for the pill pack, a pill dispensing window in the bottom wall of said base, a radially extending plunger slidably mounted in the housing operable between inner and outer limit positions, said plunger having a ramp adapted to engage the pill pack for discharging one of the pills in the pack through the window in said base during cycling of the plunger between limit positions, means for limiting rotation of the pack only one pill increment at a time, and child resistant means normally preventing cycling of the plunger between limit positions.

* * * * *